US005635687A

United States Patent [19]

Biscaldi

[11] Patent Number: 5,635,687

[45] Date of Patent: Jun. 3, 1997

[54] MUFFLER FOR MOTOR COMPRESSORS FOR REFRIGERATION APPLIANCES

[75] Inventor: Edoardo Biscaldi, Saronno, Italy

[73] Assignee: Necchi Compressori s.r.l., Pavia, Italy

[21] Appl. No.: 491,640

[22] Filed: Jun. 19, 1995

[30] Foreign Application Priority Data

Jul. 5, 1994 [IT] Italy ..... PV94A000010

[51] Int. Cl.[6] ..... F01N 1/08

[52] U.S. Cl. ..... 181/272; 181/229; 181/403

[58] Field of Search ..... 181/229, 249, 181/255, 269, 272, 282, 403; 417/312

[56] References Cited

U.S. PATENT DOCUMENTS

| | | | |
|---|---|---|---|
| 2,287,412 | 6/1942 | Bourne | 181/272 |
| 3,412,825 | 11/1968 | Hall | 181/282 |
| 4,371,053 | 2/1983 | Jones | 181/269 X |
| 5,164,552 | 11/1992 | Pandeya et al. | 181/403 X |
| 5,205,719 | 4/1993 | Childs et al. | 181/403 X |

*Primary Examiner*—Khanh Dang

*Attorney, Agent, or Firm*—Watson Cole Stevens Davis, P.L.L.C.

[57] ABSTRACT

A muffler for motor compressors for refrigeration appliances consisting of at least three expansion chambers interconnected by passages which are narrower than the chambers; a tube is located in one of said chambers and fastened to the outlet and inlet ports of said chamber. This tube is provided with openings to let the refrigerant gas flow through and for attenuating the resonance frequency of that gas. The diameter of the openings is inversely proportional to the number of openings.

3 Claims, 1 Drawing Sheet

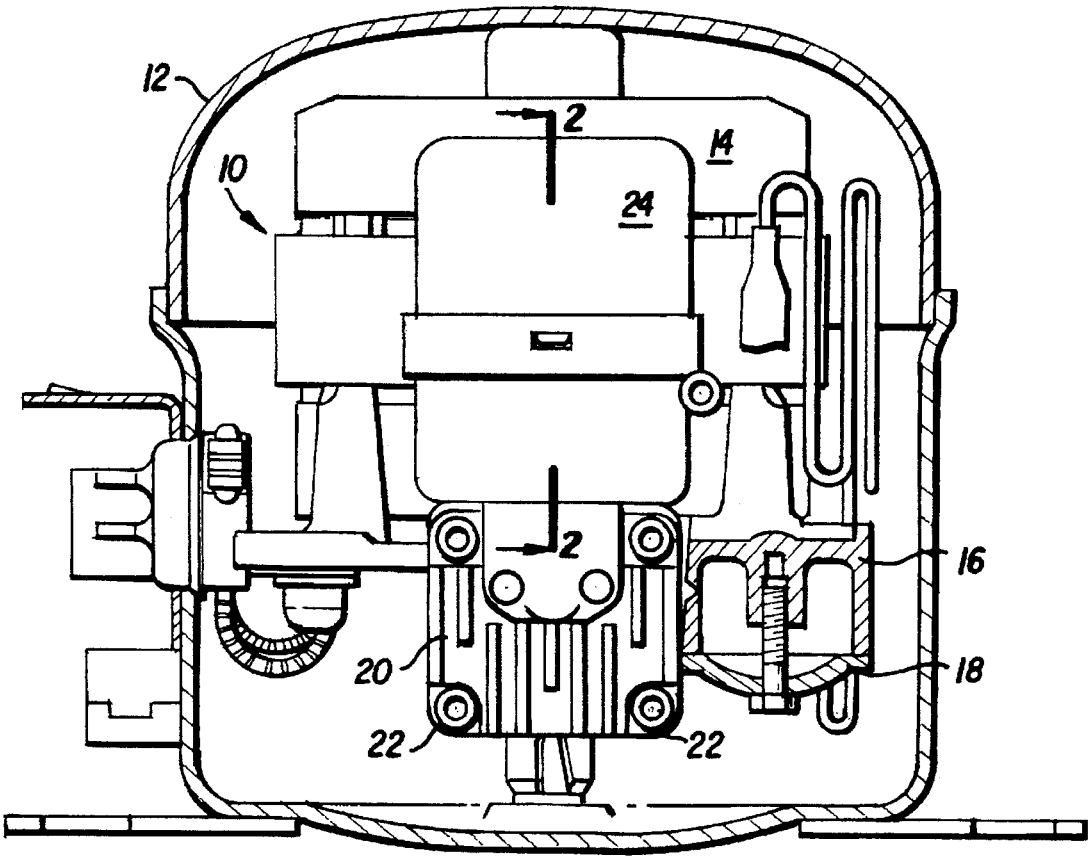
FIG. 1
FIG. 2
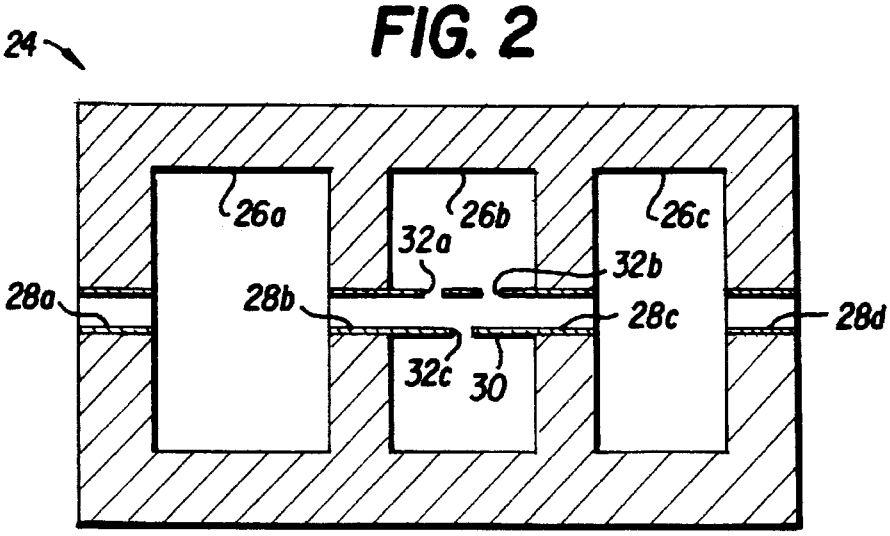

MUFFLER FOR MOTOR COMPRESSORS FOR REFRIGERATION APPLIANCES

The present invention refers to a muffler for a motor compressor for refrigeration appliances.

BACKGROUND OF THE INVENTION

In motor compressors for household refrigerators, a very important factor—besides the efficiency—is the noise, i.e. the noise produced by the motor compressor. Since said refrigeration appliances operate also by night, in absence of any sound, it is evident that noise is a very important element in faultless working of a motor compressor. As the sources of noise inside the motor compressor are different, a number of actions for reducing it have been taken e.g. on the casing, on the compressor block and on the mufflers, which are located on the suction and discharge lines; also the friction between the various moving parts has been reduced.

Generally, the structure of suction mufflers is such as to have a narrow passage through which the refrigerant gas flows from a first chamber, where the gas expands, a second chamber, connected to the first one by means of an opening or of a tube and a conduit connecting said second chamber to a suction chamber provided in the cylinder head, which closes the cylinder provided in the compressor block. This traditional muffler system reduces the noise during the suction stroke, but the results are not very satisfactory, since the sound pressure level is very high, as the resonance frequencies of the muffler which may coincide with those of the motor compressor, are not sufficiently attenuated or shifted.

The object of the present invention is to overcome the above described disadvantages.

SUMMARY OF THE INVENTION

The technical problem solved by the present invention is reduction of the noise produced by the refrigerant gas during the suction stroke, while it flows into the various chambers of the muffler. The solution of this technical problem is that the muffler is made up of at least 3 expansion chambers interconnected by passages which are narrower than the expansion chambers, means being provided in one of said chambers having a number of openings for letting the refrigerant gas through from said means to said chamber, in order to attenuate the resonance frequencies.

BRIEF DESCRIPTION OF THE DRAWINGS

Further advantages and features will become more evident from the following description and from the accompanying drawings, in which:

FIG. 1 is an elevational view, partly in section showing a hermetic compressor to which the muffler, the object of the present invention, is connected; and FIG. 2 is a cross section taken along line 2—2 of FIG. 1.

DETAILED DESCRIPTION OF A PREFERRED EMBODIMENT

Referring to FIG. 1, numeral 10 indicates the motor compressor unit enclosed in the hermetically sealed casing 12 which contains the refrigerant gas from the refrigerant circuit. The motor compressor 10 consists of electric motor 14, compressor block 16, and discharge muffler 18 formed by a casting in compressor block 16.

Cylinder head 20 is secured with bolts 22 to the cylinder, not visible on the drawings, to which the suction muffler 24 of the present invention, is connected.

Suction Muffler 24 (FIG. 2) consists of at least three expansion chambers 26*a–c* interconnected by passages 28*a–d* which are narrower than the chambers 26*a–c*.

A tube 30 is located within a central one of the expansion chambers 26*b* and is in communication with the passages 28*b* and 28*c* which are located at the inlet and outlet of said central chamber 26*b*. Tube 30 has a number of openings 32*a–c* through which a given quantity of refrigerant gas flows and expands into said center chamber 26*b*.

Thus, the resonance frequencies are attenuated, which results in a reduced sound pressure level.

To achieve a greater attenuation of the resonance frequencies, it is necessary that tube 32 has different size openings 32*a–c*. The opening size necessary to attenuate a single resonance frequency is directly proportional to the number of openings 32*a–c* and inversely proportional to their diameters.

The optimal solution provides a tube 30 with few openings 32*a–c* for each resonance having an adequate but differing diameter for each resonance frequency to be attenuated.

I claim:

1. A muffler for attenuating resonance frequencies of motor compressors for refrigerating appliances comprising at least three expansion chambers, each said chamber having an inlet and an outlet, each said inlet and outlet being a conduit which is narrower than the chamber to which said conduit is connected;

a central expansion chamber of said at least three expansion chambers having a tube extending through said central expansion chamber and connected to the inlet and outlet thereof;

said tube having a plurality of openings therein for flow of refrigerant gas from said tube for expansion into said central expansion chamber;

said opening being of a size selected for each resonance frequency to be attenuated.

2. The muffler of claim 1 in which the number of said plurality of openings is directly proportional to a single frequency and said openings are of a diameter which is inversely proportional to said single frequency.

3. The muffler of claim 1 in which said chambers are spaced apart and interconnected only by said conduit.

* * * * *